US005290674A

United States Patent [19]

Hirano et al.

[11] Patent Number: 5,290,674

[45] Date of Patent: * Mar. 1, 1994

[54] SILVER HALIDE PHOTOGRAPHIC MATERIAL

[75] Inventors: Katsumi Hirano; Katsumi Makino, both of Kanagawa, Japan

[73] Assignee: Fuji Photo Film Co., Ltd., Kanagawa, Japan

[ * ] Notice: The portion of the term of this patent subsequent to Aug. 1, 2006 has been disclaimed.

[21] Appl. No.: 996,860

[22] Filed: Dec. 16, 1992

Related U.S. Application Data

[63] Continuation of Ser. No. 282,162, Dec. 9, 1988, abandoned.

[30] Foreign Application Priority Data

Dec. 9, 1987 [JP] Japan ..... 62-311420
Jun. 22, 1988 [JP] Japan ..... 63-153721

[51] Int. Cl.[5] ..... G03C 1/035
[52] U.S. Cl. ..... 430/567; 430/611
[58] Field of Search ..... 430/567, 569, 611

[56] References Cited

U.S. PATENT DOCUMENTS 2,304,962 12/1942 Sheppard et al. ..... 430/611
3,266,897 8/1966 Kennard et al. .
4,853,322 8/1989 Makino et al. ..... 430/567
4,865,947 9/1989 Kuwabara et al. ..... 430/264
5,068,173 11/1991 Takehara et al. ..... 430/567

FOREIGN PATENT DOCUMENTS 1275701 2/1970 United Kingdom .

*Primary Examiner*—Janet C. Baxter

*Attorney, Agent, or Firm*—Sughrue, Mion, Zinn, Macpeak & Seas

[57] ABSTRACT

A silver halide photographic material comprising a support having provided thereon at least one silver halide emulsion layer, wherein the emulsion layer contains silver halide tabular grains having a diameter of not less than 0.15 μm in an amount of not less than 70% of the total projected area of the total silver halide grains, wherein at least 50% of the total number of all tabular grains have a ratio of grain thickness (b) to the longest distance between two or more parallel twinning planes (a) of not less than 5, and wherein the emulsion layer or other hydrophilic colloidal layer contains a compound represented by formula (I):

(I)

wherein Z represents a residual group of a heterocyclic ring to which at least one group selected from $—SO_3M$, $—COOR_1$, —OH, and $—NHR_2$ is bonded either directly or indirectly; M represents a hydrogen atom, an alkali metal atom, or $—NH_4$; $R_1$ represents a hydrogen atom, an alkali metal atom, or an alkyl group having from 1 to 6 carbon atoms; $R_2$ represents a hydrogen atom, an alkyl group having from 1 to 6 carbon atoms, $—COR_3$, $—COOR_3$, or $—SO_2R_3$; and $R_3$ represents an aliphatic group or an aromatic group. The photographic material exhibits high sensitivity, improved graininess, low fog, and improved low intensity reciprocity law failure.

13 Claims, No Drawings

SILVER HALIDE PHOTOGRAPHIC MATERIAL

This application is a continuation of Ser. No. 282,162 filed on Dec. 9, 1988, now abandoned.

FIELD OF THE INVENTION

The present invention relates to a photographic light-sensitive material comprising light-sensitive silver halide emulsions comprising parallel multiple twin silver halide grains which exhibits high sensitivity and improved graininess. More particularly, it relates to a silver halide color photographic material which exhibits improved sharpness, improved graininess, reduced fog, and improved reciprocity law failure.

BACKGROUND OF THE INVENTION

With the recent developments of increase of sensitivity and miniaturization of silver halide color negative films, the demand for color negative photographic materials having further increased sensitivity and excellent image quality has been increasing. In addition, the demand for photographic silver halide emulsions to meet exacting requirements of photographic performances, such as high sensitivity, high contrast, excellent graininess, and sharpness has been increasing accordingly.

In order to meet these requirements, there have been proposed techniques of using tabular grains, obtaining improvements in sensitivity inclusive of color sensitization efficiency by sensitizing dyes, relationship between sensitivity and granularity (i.e., ratio of sensitivity to granularity), sharpness, and covering power, as disclosed in U.S. Pat. Nos. 4,434,226, 4,414,310, 4,433,048, 4,414,306, and 4,459,353.

Further, JP-A-58-113930, JP-A-58-113934 and JP-A-59-119350 (the term "JP-A" as used herein means an "unexamined published Japanese patent application") disclose multilayer color photographic materials having improved sensitivity, graininess, sharpness, and dot reproducibility, in which tabular grains having an aspect ratio of 8:1 or more are used in a high-sensitive silver halide emulsion layer. According to these disclosures, use of tabular grains in a blue-sensitive emulsion layer brings about an improvement in sharpness owing to the low scattering properties of the grain. Their use in a green-or red-sensitive emulsion layer brings about an improvement in graininess.

JP-A-61-77847 proposes a multilayer color photographic material having improved sharpness and improved color reproducibility, in which tabular grains having an aspect ratio of 5:1 or more are used in a high-sensitive silver halide emulsion layer and a mono-dispersed silver halide emulsion is used in a low-sensitive emulsion layer.

In addition, *Research Disclosure* 25330 discloses a technique of controlling thickness of tabular grains. In this technique, reflection of light to which the silver halide light-sensitive layer provided over the layer containing the tabular grains is sensitive by the tabular grains is made greater so as to increase sensitivity of the light-sensitive layer, or the reflection is minimized so as not to impair sharpness of the upper layer.

As stated above, tabular grains having a high aspect ratio have various advantages to be made use of. Nevertheless, when applied to a so-called successive layer structure widespread in color photographic materials, such as for example, in which a support has provided thereon a red-sensitive layer, a green-sensitive layer, and a blue-sensitive layer each having a different sensitivity, in this order, it has been experimentally proved that use of tabular grains of high aspect ratio in light-sensitive layers, except the farthest from the support, particularly in a green- or red-sensitive layer, results in deteriorated sharpness in the low frequency side.

It has been suggested that this drawback can be overcome by using tabular grains whose uniformity is increased by specifying a relationship between a distance between twinning planes and a thickness of grains, as disclosed in Japanese Patent Application No. 311130/86 (corresponding to JP-A-63-163451). Although an emulsion comprising such tabular grains produces remarkable effects on improving sharpness, it has a tendency to cause fog on chemical ripening. This effect of inhibiting sufficient chemical ripening and, as a result, a so-called low intensity reciprocity law failure, drastically affects the commercial utility of these photographic materials.

SUMMARY OF THE INVENTION

The objects of this invention are to provide a photographic material, in which a light-sensitive silver halide emulsion contained therein comprises grains having parallel twinning planes, which exhibits low fog, improved low intensity reciprocity law failure, high sensitivity, and improved graininess.

As a results of extensive investigations, the present inventors found that the above objects can be accomplished by providing a silver halide photographic material comprising a support having provided thereon at least one silver halide emulsion layer, wherein the emulsion layer contains silver halide tabular grains having a diameter of not less than 0.15 μm in an amount of not less than 70% of the total projected area of the total silver halide grains, wherein at least 50% of the total number of all tabular grains have a ratio of grain thickness (b) to the longest distance between two or more parallel twinning planes (a), i.e., a "b/a" ratio, of not less than 5, and wherein the emulsion layer or other hydrophilic colloidal layer contains a compound represented by formula (I):

(I)

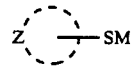

wherein Z represents a residual group of a heterocyclic ring to which at least one group selected from $—SO_3M$, $—COOR_1$, —OH, and $—NHR_2$ is bonded either directly or indirectly; M represents a hydrogen atom, an alkali metal atom, or $—NH_4$; $R_1$ represents a hydrogen atom, an alkali metal atom, or an alkyl group having from 1 to 6 carbon atoms; $R_2$ represents a hydrogen atom, an alkyl group having from 1 to 6 carbon atoms, $—COR_3$, $—COOR_3$, or $—SO_2R_3$; and $R_3$ represents an aliphatic group or an aromatic group.

DETAILED DESCRIPTION OF THE INVENTION

The terminology "tabular grains" as used herein means all grains having one twinning plane or two or more parallel twinning planes. The terminology "twinning plane" as used herein means a plane of symmetry about which ions at all the lattice points in one side and those in the other side are mirror images of each other.

The tabular grains, when seen from the upside, have a triangular or hexangular shape or a rounded triangular or hexangular shape with the corresponding parallel outer surfaces.

The grain thickness (b) is measured as the distance between the two outer surfaces parallel with each other. The thickness can easily be measured by vacuum evaporating a metal to the grain from the oblique direction, measuring the length of the shadow of the electron micrograph thereof, and calculating the grain thickness by reference to the length of the shadow of a standard latex similarly treated.

The terminology "grain diameter" as used herein means a circle equivalent diameter, i.e., a diameter of a circle having the same area as the projected area of parallel outer surfaces of an individual grain. The projected area of the grain can be obtained by measuring the area on an enlarged electron micrograph thereof and correcting the measured value for the magnification.

The terminology "average aspect ratio" as used herein means an averaged quotient obtained by dividing a diameter of a tabular grain having a longer diameter of 0.15 pm or more by a thickness (b).

The terminology "distance between twinning planes (a)" or "twinning plane distance (a)" as used herein means the distance between two twinning planes in the case of twins having two twinning planes, or the longest of the distances among three or more twinning planes in the case of grains having three or more twinning planes.

The twinning plane distance can be measured by observation under a transmission electron microscope. More specifically, an emulsion comprising tabular grains is coated on a support to prepare a sample wherein the tabular grains are aligned substantially in parallel with the support, and the sample is sliced with a diamond knife to a thickness of about 0.1 μm. The slice is observed under a transmission electron microscope to examine the twinning planes. The existence of twinning planes can be recognized through a phase difference of an electron beam transmitted through the twinning planes.

Estimation of the twinning plane distance of the tabular grain may also be made with reference to the method described in J. F. Hamilton and L. F. Brady, et al, *J. Appl. Phys.*, Vol. 35, 414–421 (1964), but the above-stated method is simpler and more convenient.

In the present invention, at least 70% of the total projected area of the total silver halide grains in the emulsion layer comprising tabular grains comprises tabular grains having a diameter of 0.15 μm or more. The proportion of such tabular grains is preferably 80% or more, more preferably 90% or more.

The diameter of the tabular grains generally ranges from 0.15 to 5.0 μm, preferably from 0.20 to 2.0 μm, and more preferably from 0.25 to 1.2 μm.

The thickness of the tabular grains is generally in the range of from 0.05 to 1.0 pm, preferably from 0.1 to 0.5 pm, more preferably from 0.1 to 0.3 μm.

In the present invention, at least 50%, preferably at least 70%, more preferably at least 90%, of the number of the total tabular grains comprises those having a b/a ratio of 5 or greater, preferably 5 to 50. It is preferable that at least 50%, more preferably at least 70%, most preferably at least 90%, of the number of the tabular grains comprise those having a b/a ratio of 10 or more, preferably 10 to 20.

It is also preferable that coefficient of variation of b (grain thickness), b/a ratio, and projected area of tabular grains are not more than 20%, not more than 20%, and not more than 30%, respectively.

The terminology "coefficient of variation of b, b/a ratio, and projected area of tabular grains" as used herein means a value obtained by dividing the respective standard deviation by the respective mean value and multiplying the quotient by 100.

Halogen composition of silver halide grains in photographic emulsions used in the present invention may be any of silver bromide, silver iodobromide, silver iodochloride, silver chlorobromide, and silver chloride. The individual grains may have a heterogeneous phase comprising double or multiple layers substantially differing in halogen composition or a homogeneous phase therethrough. Grains individually having a double layered structure may be composed of a core with a high iodide content and a shell with a low iodide content or vice versa. In the case of a multi-layered structure composed of three or more layers, it is preferable that the iodide content is decreasing toward the outer layer.

The silver halide emulsions of the present invention are not particularly limited by the average aspect ratio. However, since tabular grains, in nature of their shape, are apt to cause fog on pressure application, they preferably have an average aspect ratio of 8.0 or smaller, more preferably 2.0 to 8.0.

The photographic emulsion of the present invention can be prepared by a precipitation process as described below. A dispersing medium is charged in a commonly employed reaction vessel equipped with a stirring mechanism. The amount of the dispersing medium charged in the initial stage of grain formation is generally at least about 10%, preferably from 20 to 80%, of the total amount of the dispersing medium present in the silver halide emulsion, for example, a silver iodobromide emulsion, obtained in the final stage. The dispersing medium used in the initial stage includes water and an aqueous dispersion of a deflocculant such as gelatin. If desired, the dispersing medium may contain other components, such one or more of silver halide ripening agents and/or a metal dopant as described hereinafter. In cases using a deflocculant from the beginning of grain formation, it is preferably added in an amount of at least 10%, more preferably at least 20%, of the total amount of the deflocculant present in the final stage. An additional amount of the dispersing medium, which is added later together with a silver salt and halides, may be introduced from a jet separately provided. In order to increase the proportion of the deflocculant, the proportion of the dispersing medium is usually adjusted after completion of the halide introduction.

A bromide is also introduced in the initial stage usually in an amount of 0 to less than 10% by weight based on the whole bromide used for silver iodobromide grain formation to thereby adjust a bromide ion concentration in the dispersing medium at the start of grain formation. The dispersing medium in the reaction vessel in the initial stage contains substantially no iodide on. If an iodide ion is present in the medium before the simultaneous addition of a silver salt and a bromide, there is a tendency that not only thick non tabular grains are formed, but the resulting tabular grains have an irregular distance between twinning planes as observed according to the above-stated method, resulting in broadening of b/a ratio distribution. The term "substantially no iodide ion" referred to above means that the iodide ion concentration is too small to be precipitated as an independent silver iodide phase as compared with a bromide ion. The iodide concentration in the system before introduction of a silver salt is preferably maintained at a level of 0 to less than 0.5 mol% based on the total halide ion concentration in the system.

If a pBr value of the dispersing medium is too high from the beginning, the formed silver iodobromide tabular grains become relatively thick and have a broad thickness distribution and a broad b/a ratio distribution. In addition, non-tabular grains increase in number. The tendency to form non-tabular grains is also noted if the pBr value is too low. As a result of study while observing a twinning plane distance of tabular silver iodobromide grains, it has been confirmed that thickness and b/a ratio distributions can be made narrow by maintaining a pBr value of the grain formation system not less than 0.6 and less than 2.0, preferably not less than 1.1 and less than 1.8. The pBr value is defined as a negative value of a logarithm of the bromide ion concentration.

For precipitate formation, a silver salt, a bromide, and an iodide are added to the reaction medium in accordance with techniques well known in the art. Simultaneous with the introduction of a bromide and an iodide, an aqueous solution of a soluble silver salt, e.g., silver nitrate is added. The bromide and iodide are fed in the form of an aqueous solution of a salt, such as a soluble ammonium halide, an alkali metal (e.g., sodium, potassium) halide, and an alkaline earth metal (e.g., magnesium, calcium) halide. The silver salt is fed separately from the bromide and iodide at least in the initial stage of grain formation. The bromide and iodide may be fed either separately or as a mixture thereof.

On introduction of a silver salt into the system, nucleation starts. Introduction of the silver salt, bromide and iodide being continued, a cluster of grain nucleus serving as a site of precipitation of silver bromide and silver iodide is formed. The grains then reach a stage of growth in which silver bromide and silver iodide are precipitated onto the existing grain nuclei. The tabular grains, immediately before entering a growth stage, preferably have an average circle equivalent diameter of the projected area of not more than 0.6 μm, more preferably not more than 0.4 μm. The nucleation conditions can be determined with reference to the process disclosed in Japanese Patent Application No. 48950/86 (corresponding to JP-A-63-11937), but other conditions may also be used. For example, the nucleation temperature can be selected from the range of from 5 to 55° C.

Size distribution of the formed tabular grains is greatly influenced by concentrations of the bromide and iodide present in the growth stage. If the pBr value is too low, a coefficient of variation of projected area becomes considerably large, although tabular grains of high aspect ratio may be formed. By controlling the pBr value to be between about 2.2 and 5, preferably between 2.5 and 4, tabular grains having a small coefficient of variation of projected area can be formed.

As long as the pBr condition stated above is satisfied, concentrations and feed rates of silver salt, bromide, and iodide may be in accordance with conventionally employed practices. Feed rates of silver salt and halides desirably range from 0.1 to 5 mol/1, but may be selected from a range wider than that commonly used, for example, from 0.01 mol/l to a saturation point. A particularly preferred technique for grain formation comprises increasing the feed rates of silver salt and halides, thereby reducing the time required for grain formation. Such can be effected by increasing the feed rates of the dispersing medium, silver salt, and halides or by increasing concentrations of silver salt and halides in the dispersing medium to be fed. The coefficient of variation of projected area of grains can further be reduced by maintaining the feed rates of silver salt and halides near to the limiting value at which formation of new nuclei takes place, as described in JP-A-55-142329.

Achievement of a regular b/a ratio requires not only due selection of a pBr value and temperature during the nucleation and grain growth stages, but also consideration for the following factors.

The amount of gelatin present in the reaction vessel during nucleation has a significant influence on grain size distribution. Improper selection of the gelatin amount results in non-uniform nucleation, leading to large scatter of the b/a ratio among grains as observed by the above-described method. The gelatin concentration therefore, preferably ranges from 0.5 to 10% by weight, more preferably from 0.5 to 6% by weight.

Grain size and b/a ratio distributions are also influenced by the number of revolutions for stirring and the shape of the reaction vessel used. A preferred stirring apparatus is of the type in which a reaction mixture is added to a liquid and mixed as described in U.S. Pat. No. 3,785,777. The number of revolutions should not be too low or too high. If it is too low, the production proportion of non-parallel twins increases; if it is too high, the production frequency of tabular grains decreases and the size distribution becomes undesirably broad. It is most preferable to use a reaction vessel with a hemispherical bottom.

The compound represented by formula (I) which can be incorporated into the above-described emulsion layer comprising tabular grains or any other hydrophilic colloidal layer is hereinafter described.

(I)

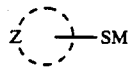

In formula (I), Z represents a heterocyclic ring residue to which at least one of —$SO_3M$, COOM, —OH, and —$NHR_2$ is bonded either directly or via methylene, 1,3-propylene or 1,4-phenylene, indirectly. Examples of the heterocyclic group include residues of oxazole, thiazole, imidazole, selenazole, triazole, tetrazole, thiadiazole, oxadiazole, pentazole, pyrimidine, thiazine, triazine, and thiodiazine rings; and residues of these rings to which another carbon ring or hetero ring is fused, e.g., benzothiazole, benzotriazole, benzimidazole, benzoxazole, benzoselenazole, naphthoxazole, triazaindolizine, diazaindolizine, and tetraazaindolizine rings. Preferred among these are imidazole, tetrazole, benzimidazole, benzothiazole, bezoxazole, and triazole rings.

In formula (I), M represents a hydrogen atom, an alkali metal atom, a quaternary ammonium group, or a quaternary phosphonium group; and $R_2$ represents a hydrogen atom, an alkyl group having from 1 to 6 carbon atoms, —$COR_3$, —$COOR_3$, or —$SO_2R_3$, wherein $R_3$ represents a hydrogen atom, an unsubstituted aliphatic group an aliphatic group substituted by a halogen atom, a hydroxy group, an alkoxy group or an amino group, or a substituted or unsubstituted aromatic group.

Of the compounds represented by formula (I), preferred are those represented by formula (II):

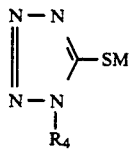

(II)

wherein $R_4$ represents an aliphatic, aromatic or heterocyclic group substituted with at least one of —COOM and —$SO_3M$, wherein M is as defined above.

More preferred are those represented by formula (III):

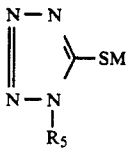

(III)

wherein $R_5$ represents a phenyl group substituted with at least one of —COOM and —$SO_3M$; and M is as defined above.

Specific examples of the compounds of formula (I) are shown below for illustrative purposes; however, the present invention is not limited thereto.

1)

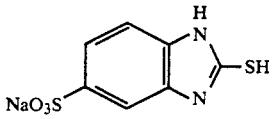

2)

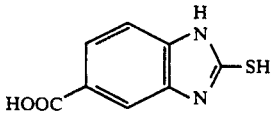

3)

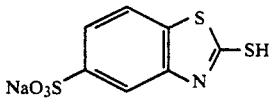

4)

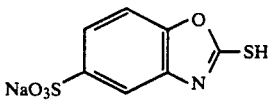

5)

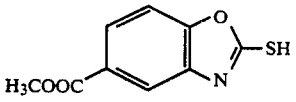

6)

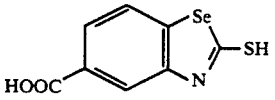

7)

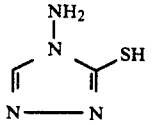

-continued

8)

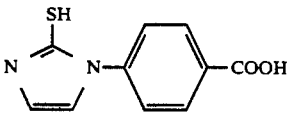

9)

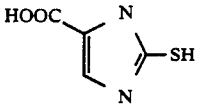

10)

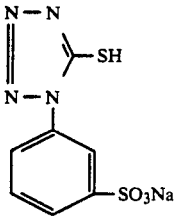

11)

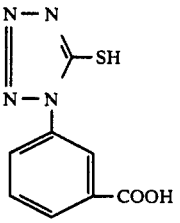

12)

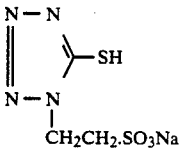

13)

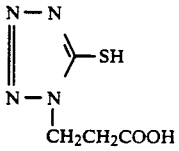

14)

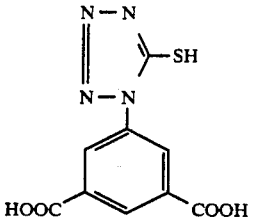

15)

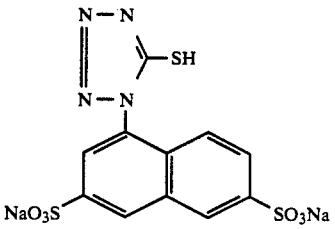

16)

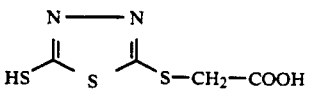

The compounds of formula (I) can be synthesized by known processes disclosed, i.e., in U.S. Pat. No. 3,266,897; British Patent 1,275,701; R. G. Dubenko and V. D. Panchenko, *Khim. Getevotsiki Sodedin Sb-1, Azots. odev. Zhaschie Geterofsiky,* 199-201 (1967); and K. Hotwann, *The Chemistry of Heterocyclic Compounds, Imidazole and Its Derivatives,* Part 1, 384, Interscience (1953).

Incorporation of a compound of formula (I) into a photographic emulsion can be carried out by methods usually adopted for incorporation of photographic compound can be dissolved in methyl alcohol, ethyl alcohol, methyl cellosolve, acetone, water, or a mixture thereof, and the resulting solution then added to the emulsion.

Addition of a compound of formula (I) to the emulsion may be effected at any stage during preparation of the emulsion or at any stage after the preparation up to coating. Addition is preferably conducted at any stage after formation of silver halide grains up to a chemical ripening.

A compound of formula (I) is generally added in an amount of from $1\times10^{-6}$ to $1\times10^{-1}$ mol/mol of silver, preferably from $1\times10^{-5}$ to $8\times10^{-3}$ mol/mol of silver in the emulsion.

The silver halide emulsion according to the present invention produces the most marked effects when used in a layer other than the outermost layer of color light-sensitive material as mentioned above. It is also applicable to other types of light-sensitive materials, such as X-ray light-sensitive materials, black-and-white light-sensitive materials for photography, light-sensitive materials for photomechanical process, photographic papers, and the like.

There are no particular limitations to the kinds of photographic additives that can be added to the silver halide emulsion of the invention, such as binders, chemical sensitizers, spectral sensitizers, stabilizers, gelatin hardening agents, surface active agents, antistatic agents, polymer latices, matting agents, color forming couplers, ultraviolet absorbents, discoloration inhibitors, dyes, etc.; kinds of a support on which the emulsion is provided; as well as methods for coating, exposure, and development processing, and the like. Reference can be made thereto in, e.g., *Research Disclosure,* Vol. 176, Item 17643 (RD-17643), ibid, Vol. 187, Item 18716 (RD-18716), ibid, Vol. 225, Item 22534 (RD-22534), and JP-A-62-215272. The disclosures of *Research Disclosures* are summarized below.

| Photographic Additives | | | | |
|---|---|---|---|---|
| Kind | RD17643 | RD18716 | RD22534 | JP-A-62-215272 |
| Chemical sensitizer | p. 23 | p. 648 right column (RC) | p. 24 | |
| Sensitivity increasing agent | | p. 648 right column (RC) | | |
| Spectral sensitizer and supersensitizer | pp. 23-24 | p. 648 RC-p. 649 RC | pp. 24-28 | p. 728 lower left column (LC)-p. 747 |
| Brightening agent | p. 24 | | | |
| Antifoggant and stabilizer | pp. 24-25 | p. 649 RC | p. 24, p. 30 | p. 695 upper LC-p. 728 pp. 814-840 |
| Light absorbent, filter dye, and ultraviolet absorbent | pp. 25-26 | p. 649 RC-p. 650 LC | | |
| Stain inhibitor | p. 25 RC | p. 650 LC-RC | | |
| Dye image stabilizer | p. 25 | | p. 32 | p. 781 upper RC-p. 793, pp. 841-849 |
| Hardening agent | p. 26 | p. 651 LC | p. 28 | p. 802 upper RC-p. 811 |
| Binder | p. 26 | " | | |
| Plasticizer and lubricant | p. 27 | p. 650 RC | | pp. 874-881, p. 895 |
| Coating aid and surface active agent | pp. 26-27 | " | | pp. 859-866 |
| Antistatic agent | p. 27 | " | | pp. 867-873, p. 884-885 |
| Color forming coupler | p. 25 | p. 649 | p. 31 | p. 747 upper RC-p. 777 |
| High-boiling organic solvent | | | | p. 793 lower LC-p. 800 |

Yellow couplers which can be used in the present invention typically include oil-protected acylacetamide couplers. Specific examples are given in U.S. Pat. Nos. 2,407,210, 2,875,057, and 3,265,506. Two-equivalent yellow couplers are preferred. Typical examples of such couplers are those having coupling off groups linked through oxygen atom as described in U.S. Pat. Nos. 3,408,194, 3,447,928, 3,933,501, and 4,022,620; and those having coupling off groups linked through nitrogen atom as described in JP-B-58-10739 (The term "JP-B" as used herein means an "examined Japanese patent publication"), U.S. Pat. Nos. 4,401,752 and 4,326,024, *Research Disclosure,* No. 18053 (Apr., 1979), British Patent 1,425,020, and West German Patent Application (OLS) Nos. 2,219,917, 2,261,361, 2,329,587, and 2,433,812. Inter alia, α-pivaloylacetanilide couplers are excellent in fastness of the developed color, particularly light fastness, and α-benzoylacetanilide couplers provide high color densities.

Magenta couplers which can be used in the present invention include oil-protected indazolone or cyanoacetyl couplers, preferably 5-pyrazolone couplers and pyrazoloazole couplers, such as pyrazolotriazoles. The 5-pyrazolone couplers preferably have an arylamino group or an acylamino group at the 3-position thereof from the standpoint of hue and density of the developed color. Typical examples of such couplers are described, i.e., in U.S. Pat. Nos. 2,311,082, 2,343,703, 2,600,788, 2,908,573, 3,062,653, 3,152,896 and 3,936,015. Preferred coupling off groups for 2-equivalent 5-pyrazolone couplers are nitrogen-atom linked coupling off groups as described in U.S. Pat. No. 4,310,619 and an arylthio group as described in U.S. Pat. No. 4,351,897. 5-Pyrazolone couplers having the ballast group as described in European Patent 73,636 provide high color densities. The pyrazoloazole couplers include pyrazolobenzimidazoles described in U.S. Pat. No. 3,061,432, and preferably pyrazolo[5,1-c][1,2,4]triazoles described in U.S. Pat. No. 3,725,067, pyrazolotetrazoles described in *Research Disclosure,* No. 24220 (June, 1984) and JP-A-60-33552, and pyrazolopyrazoles described in *Research*

*Disclosure,* No. 24230 (June, 1984) and JP-A-60-43659. From the standpoint of reduced side absorption of yellow and light-fastness of the developed color, the imidazolo[1,2-b]pyrazoles described in U.S. Pat. No. 4,500,630 are preferred, and the pyrazolo[1,5b][1,2,4]triazoles described in U.S. Pat. No. 4,540,654 are particularly preferred.

Cyan couplers which can be used in the present invention include oil-protected naphthol and phenol couplers. Typical examples are naphthol couplers described in U.S. Pat. No. 2,474,293, and preferably 2equivalent naphthol couplers having coupling off groups linked through oxygen atom described in U.S. Pat. Nos. 4,052,212, 4,146,396, 4,228,233, and 4,296,200. Examples of the phenol couplers are described in U.S. Pat. Nos. 2,369,929, 2,801,171, 2,772,162, and 2,895,826. Cyan couplers exhibiting fastness to moisture and heat are preferred. Typical examples of such cyan couplers are phenol couplers having an alkyl group containing 2 or more carbon atoms at the m-position of the phenol nucleus as described in U.S. Pat. No. 3,772,002; 2,5-diacylamino-substituted phenol couplers described in U.S. Pat. Nos. 2,772,162, 3,758,308, 4,126,396, 4,334,011, and 4,327,173, West German Patent Application (OLS) No. 3,329,729, and European Patent 121,365; and phenol couplers having a phenylureido group at the 2-position and an acylamino group at the 5-position as described in U.S. Pat. Nos. 3,446,622, 4,333,999, 4,451,559, and 4,427,767. Naphthol couplers having a sulfonamido group or an amido group at the 5-position of the naphthol moiety as disclosed in JP-A-60-237448, JP-A-61-153640, and JP-A-61-145557 are also advantageously used because of excellent fastness of a cyan image produced therefrom.

A combined use of a coupler which forms a dye having moderate diffusibility is effective to improve raininess. Examples of such a coupler are described in U.S. Pat. No. 4,336,237 and British Patent 2,125,570 as for magenta couplers; and in European Patent 96,570 and West German Patent Application (OLS) No. 3,234,533 as for yellow, magenta and cyan couplers.

The dye forming couplers and the above-described special couplers may be in the form of a polymer including a dimer.

Couplers capable of releasing a development inhibitor on development processing (so-called DIR couplers) can also be advantageously used . in this invention. Examples of DIR couplers are those releasing a heterocyclic mercapto compound as described in U.S. Pat. No. 3,227,554; those releasing a benzotriazole derivative as described in JP-B-58-9942; the so-called colorless compound forming DIR couplers as described in JP-B-51-16141; and those releasing, after their own release, a nitrogen-containing heterocyclic compound on decomposition of a methylol group as described in JP-A-52-90932.

DIR couplers which are preferably combined with the present invention include those which are inactivated in a developer as described in JP-A-57-151944; timing-type DIR couplers as described in U.S. Pat. No. 4,248,962 and JP-A-57-154234; and reactive-type DIR couplers as described in JP-A-60-184248. Particularly preferred among them are those inactivated in a developer as described in JP-A-57-51944, JP-A-58-217932, JP-A-60-218644, JP-A-60-225156 and JP-A-60-233650; and reactive type DIR couplers described in JP-A-60-184248, with those inactivated in a developer being most preferred.

The present invention will now be illustrated in greater detail by way of the following Examples, but it should be understood that the present invention is not deemed to be limited thereto. In these examples, all the percents are by weight unless otherwise indicated.

EXAMPLE 1

Preparation of Emulsion A

Step (a)

Into a 4 l-volume reaction vessel, as aqueous gelatin solution consisting of 1,350 ml of water, 17 g of gelatin, and 3.7 g of potassium bromide (adjusted to a pH of 6.0 with 1.2 ml of a 1N potassium hydroxide aqueous solution) having a pBr of 1.47 was charged and kept at 45° C. To the solution were added simultaneously 67.7 ml of a silver nitrate aqueous solution containing 0.90 mol/l of silver nitrate and 67.7 ml of an aqueous solution containing 0.85 mol/l of potassium bromide and 0.04 mol/l of potassium iodide at a constant feed rate over 45 seconds, and the solution was allowed to stand for 5 minutes. The solution temperature was elevated to 65° C. To the solution were further added 241 g of a 10% aqueous gelatin solution, and the resulting solution was allowed to stand for 30 minutes.

Step (b)

Subsequently, added to the solution were a silver nitrate aqueous solution containing 1.76 mol/l of silver nitrate and an aqueous solution containing 2.72 mol/l of potassium bromide and 0.056 mol/l of potassium iodide over a period of 60 minutes while maintaining the pBr at 3.6 by a double jet method while increasing the feed rates so as to be doubled at the time of completion of the addition until 655 ml of the silver nitrate aqueous solution had been added.

After completion of precipitation, the emulsion was cooled to 40° C., and 1.65 l of a 15.3% aqueous solution of phthalated gelatin was added thereto. The resulting emulsion was washed twice according to a flocculation method as described in U.S. Pat. No. 2,614,929.

Then, 0.55 l of a 10.5% aqueous solution of bone gelatin were added, thereby adjusting the pH to 5.5 and the pBr to 3.1 at 40° C. The resulting emulsion was designated as Emulsion A.

The thus formed silver halide grains were tabular grains having an iodide content of 2 mol% as a whole, an average particle diameter of 0.7 μm, and an average aspect ratio of 2.0. On examination of twinning planes of the tabular grains by the method described above, the value "a" was found to be 0.03 μm, which was approximately equal to the grain thickness at the time of completion of the step (a), the b/a ratio being about 12.

Preparation of Emulsion B

Emulsion B was prepared in the same manner as for Emulsion A, except for changing the pBr value in step (b) from 3.6 to 1.5.

Preparation of Emulsion C

Step (a)

An aqueous gelatin solution containing 1,350 ml of water, 17 g of gelatin, and 3.7 g of potassium bromide was prepared and kept at 45° C. To the solution were added simultaneously 67.7 ml of a silver nitrate aqueous solution containing 0.90 mol/l of silver nitrate and 67.7 ml of an aqueous solution containing 0.85 mol/l of potassium bromide and 0.40 mol/l of potassium iodide at a constant feed rate over 45 seconds. After allowing the mixture to stand for 5 minutes, the temperature was elevated to 65° C., and 241 g of a 10% aqueous gelatin solution were added thereto, and the resulting solution was allowed to stand for 30 minutes.

Step (b)

To the mixture were subsequently added an aqueous silver nitrate solution containing 1.76 mol/l of silver nitrate and an aqueous solution containing 2.72 mol/l of potassium bromide and 0.236 mol/l of potassium iodide while maintaining the pBr value at 3.0 at a constant feed rate over 30 minutes until 355 ml of the silver nitrate aqueous solution was added.

Step (c)

An aqueous silver nitrate solution containing 1.76 mol/l of silver nitrate and an aqueous solution containing 2.72 mol/l of potassium bromide were then added thereto at constant feed rates over 15 minutes while keeping the pBr value at 3.0 until 300 ml of the silver nitrate aqueous solution were added.

Step (d)

After completion of the precipitation, the emulsion was cooled to 40° C., and 1.65 l of a 15.3% aqueous solution of phthalated gelatin were added thereto. The emulsion was washed twice by a flocculation method as described in U.S. Pat. No. 2,614,929. Then, 0.55 l of a 10.5% aqueous solution of bone gelatin was added thereto, thereby adjusting the pH to 5.5 and the pBr to 3.1 at 40° C. The resulting emulsion was designated as Emulsion C.

Preparation of Emulsion D

Emulsion D was prepared in the same manner as for Emulsion A, except that the amounts of potassium bromide and gelatin in the reaction vessel in the initial stage were changed from 3.7 g to 4.2 g and from 17 g to 21 g, respectively, and that the system in the initial stage further contained 3 g of potassium iodide.

Properties of Emulsions A to D are shown in Table 1 below. The b/a ratios and proportions of grains having a particular b/a ratio were determined in accordance with the method disclosed in Japanese Patent Application No. 311130/86 (corresponding to JP-A-63-163451).

TABLE 1

| Emulsion | Iodide Content (mol %) | Proportion of b/a ≧ 5 Particles (%) | Proportion of b/a ≧ 10 Particles (%) | Average Aspect Ratio |
|---|---|---|---|---|
| A | 2 | 100 | 95 | 2 |
| B | 2 | 70 | 10 | 9.0 |
| C | 4 | 80 | 20 | 6.5 |
| D | 3.6 | 30 | — | 6.0 |

Each of Emulsions A to D was chemically sensitized under optimal conditions as shown in Table 2 below and then spectrally sensitized to a green region under optimum conditions as shown also in Table 2.

Then, Compound (10) was added to the emulsion under conditions indicated in Table 2 to prepare Emulsions 1 to 10.

TABLE 2

| Sample No. | Emulsion | Chemical Sensitization* Gold | Sulfur | Thiocyanate | Ripening Temp. (°C.) | Time (min) | Addition of Compound (10) Amount (mol/mol-Ag) | Stage of Addition | Color Sensitization Sensitizer | Amount (mg/mol-Ag) | Remark |
|---|---|---|---|---|---|---|---|---|---|---|---|
| 1 | A | 3.5 | 10 | 200 | 70 | 30 | — | — | A** | 400 | Comparison |
| 2 | A | 3.5 | 10 | 200 | 70 | 55 | $7 \times 10^{-5}$ | at the time of chemical sensitization | A** | 400 | Invention |
| 3 | A | 3.5 | 10 | 200 | 70 | 60 | — | — | A** | 400 | Comparison |
| 4 | A | 3.5 | 10 | 200 | 70 | 60 | $5 \times 10^{-4}$ | immediately before coating | A** | 400 | Invention |
| 5 | B | 3.5 | 10 | 200 | 70 | 30 | — | — | A** | 400 | Comparison |
| 6 | B | 3.5 | 10 | 200 | 70 | 55 | $7 \times 10^{-5}$ | at the time of chemical sensitization | A** | 400 | Invention |
| 7 | C | 3.5 | 10 | 200 | 70 | 30 | — | — | A** | 400 | Comparison |
| 8 | C | 3.5 | 10 | 200 | 70 | 55 | $7 \times 10^{-5}$ | at the time of chemical sensitization | A** | 400 | Invention |
| 9 | D | 3.5 | 10 | 200 | 70 | 45 | — | — | A** | 400 | Comparison |
| 10 | D | 3.5 | 10 | 200 | 70 | 60 | $7 \times 10^{-5}$ | at the time of chemical sensitization | A** | 400 | Invention |

Note:
*Gold: potassium tetrafluoroaurate (mg/mol-Ag)
Sulfur: sodium thiosulfate pentahydrate (mg/mol-Ag)
**A: Anhydro-5-chloro-9-ethyl-5'-phenyl-3'-(3-sulfobutyl)-3-(3-sulfopropyl)oxacarbocyaninehydroxy sodium salt Preparation of Light-Sensitive Material An emulsion layer and a protective layer, each having the following composition, were coated onto a triacetyl cellulose film support having a subbing layer to prepare a light-sensitive material (Samples 1 to 10).

| | | |
|---|---|---|
| (1) | Emulsion layer: | |
| | Each of Emulsions 1 to 10 | $2.1 \times 10^{-2}$ mol-Ag/m$^2$ |
| | Coupler of formula: | $1.5 \times 10^{-3}$ mol/m$^2$ |

-continued

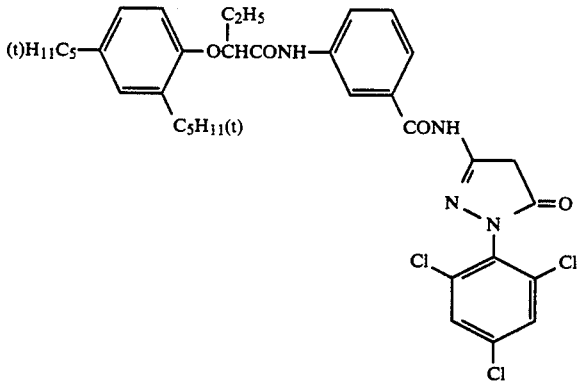

| | | |
|---|---|---|
| | Tricresyl phosphate | 1.10 g/m$^2$ |
| | Gelatin | 2.30 g/m$^2$ |
| (2) | Protective Layer: | |
| | 2,4-Dichlorotriazine-6-hydroxy-s-triazine sodium salt | 0.08 g/m$^2$ |
| | Gelatin | 1.80 g/m$^2$ |

The samples were allowed to stand at 40° C. and 70% RH for 14 hours, sensitometrically exposed to light for 1/100 seconds or 1 second, and subjected to color development processing according to the following procedure.

| | |
|---|---|
| Development Processing (38° C.): | |
| 1. Color development . . . 2'45" | ' = minutes |
| 2. Bleach . . . 6'30" | " = seconds |
| 3. Washing . . . 3'15" | |
| 4. Fixation . . . 6'30" | |
| 5. Washing . . . 3'15" | |
| 6. Stabilization . . . 3'15" | |
| Color Developer: | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N-Ethyl-N-β-hydroxyethylamino)-2-methylaniline sulfate | 4.5 g |
| Water to make | 1 l |
| Bleaching Solution: | |
| Ammonium bromide | 160.0 g |
| Aqueous ammonia (28%) | 25.0 ml |
| Sodium ethyenediaminetetraacetato ferrate | 130 g |
| Glacial acetic acid | 14 ml |
| Water to make | 1 l |
| Washing Water: | |
| Plain water | |
| Fixer: | |
| Sodium tetrapolyphosphate | 2.0 g |
| Sodium sulfite | 4.0 g |
| Ammonium thiosulfate (70%) | 175.0 ml |
| Sodium bisulfite | 4.6 g |
| Water to make | 1 l |
| Stabilizing Solution: | |
| Formalin | 80 ml |
| Water to make | 1 l |

Each of the thus processed samples was evaluated for green sensitivity, fog, granularity, and sharpness in accordance with the following test methods.

1) Fog

The transmission density of the unexposed area was measured.

2) Relative Green Sensitivity

Green sensitivity was obtained as a reciprocal of an exposure (lux.sec) providing a density of fog +0.2. The result was relatively expressed taking the sensitivity of Sample 1 exposed for 1/100 seconds as a standard (100).

3) RMS Granularity

The sample was uniformly exposed to light at an exposure providing a density of fog +0.2 and subjected to development processing as described above. RMS granularity was measured through a G filter in accordance with the method described in *The Theory of the Photographic Process,* P.619, MacMillan.

4) Sharpness

Sharpness was evaluated by determining MTF in accordance with the method described in *Journal of Applied Photographic Engineering,* Vol. 6(1), 1–8 (1980), except that the development processing was in accordance with the above-stated procedure. The MTF value obtained was relatively expressed taking that of those samples where Emulsion A was used as a standard (100).

The results of these evaluations are shown in TABLE 3.

TABLE 3

| Sample No. | Green Sensitivity 1/100 sec | Green Sensitivity 1 sec | Fog | RMS Granularity | MTF | Remarks |
|---|---|---|---|---|---|---|
| 1 | 100 | 65 | 0.27 | 0.043 | 100 | Comparison |
| 2 | 110 | 105 | 0.22 | 0.043 | 100 | Invention |
| 3 | 95 | 90 | 0.42 | 0.043 | 100 | Comparison |
| 4 | 100 | 90 | 0.23 | 0.043 | 100 | Invention |
| 5 | 90 | 60 | 0.27 | 0.051 | 88 | Comparison |
| 6 | 100 | 70 | 0.23 | 0.051 | 88 | Invention |
| 7 | 85 | 55 | 0.27 | 0.048 | 94 | Comparison |
| 8 | 100 | 70 | 0.22 | 0.048 | 94 | Invention |
| 9 | 50 | 45 | 0.23 | 0.054 | 80 | Comparison |
| 10 | 50 | 50 | 0.21 | 0.054 | 80 | Comparison |

Table 3 reveals that the relationship between sensitivity and granularity is improved as the proportion of grains having a b/a ratio of 5 or more or a b/a ratio of 10 or more increases and that addition of a compound of formula (I) inhibits increase of fog thereby increasing sensitivity at a low exposure, as shown in the samples according to the present invention. It can be seen by comparing Sample 1 and Samples 3 and 4 that mere progress of chemical sensitization, i.e., prolongation of a chemical sensitization time, aiming to obtain a high sensitivity at a low exposure as conventionally proposed, ultimately results in an increased fog, and thus is commercially undesirable. Thus, improvement in low intensity reciprocity failure is not achieved unless a compound of formula (I) is added to the emulsion.

Separately, the samples were allowed to stand at 40° C. and 70% RH for 14 hours, and their pressure characteristics were then evaluated as follows.

The sample was placed in an atmosphere of 55% RH for at least 3 hours, and the emulsion surface was scratched with a stylus of 0.1 mm in diameter under a load of 4 g at a speed of 1 cm/sec in the same atmosphere. Thereafter, the sample was sensitometrically exposed to light and subjected to the same color development processing as used above.

The density each of the area having received the pressure and the area having received no pressure was measured by using a measuring slit of 5 μm ×1 mm. A difference of fog (Δfog) between these areas is shown in Table 4 below.

TABLE 4

| Sample No. | ΔFog | Remark |
|---|---|---|
| 1 | 0.15 | Comparison |
| 2 | 0.04 | Invention |
| 3 | 0.20 | Comparison |
| 4 | 0.06 | Invention |
| 5 | 0.20 | Comparison |
| 6 | 0.10 | Invention |
| 7 | 0.15 | Comparison |
| 8 | 0.05 | Invention |
| 9 | 0.22 | Comparison |
| 10 | 0.17 | Comparison |

It is apparent from Table 4 that the samples according to the present invention exhibit improved pressure characteristics (fog increase due to pressure application) which are attributable to the addition of a compound of formula (I). It can further been seen by a comparison between Samples 6 and 8 that the aspect ratio of tabular grains is preferably 8 or less.

EXAMPLE 2

Emulsions 11 to 15 were prepared from Emulsion A as prepared in Example 1 in the same manner as for Emulsion 2 of Example 1, except for replacing Compound (10) with the compound shown in Table 5.

Light-sensitive samples 11 to 15 were prepared by using each of the resulting emulsions in the same manner as in Example 1. Results of sensitometry are shown in Table 5. For comparison, the data of Sample 1 prepared in Example 1 is also included in Table 5.

TABLE 5

| Sample No. | Compound (I) Kind | Compound (I) Amount Added (mol/mol-Ag) | Ripening Time (min) | Fog | Relative Sensitivity 1/100 Sec. | Relative Sensitivity 1 sec | Remark |
|---|---|---|---|---|---|---|---|
| 1 | — | — | 30 | 0.27 | 100 | 65 | Comparison |
| 11 | (1) | $7 \times 10^{-5}$ | 55 | 0.23 | 95 | 80 | Invention |
| 12 | (7) | $7 \times 10^{-5}$ | 55 | 0.22 | 97 | 80 | Invention |
| 13 | (11) | $7 \times 10^{-5}$ | 55 | 0.26 | 110 | 100 | Invention |
| 14 | (12) | $7 \times 10^{-5}$ | 55 | 0.25 | 97 | 85 | Invention |
| 15 | (14) | $7 \times 10^{-5}$ | 55 | 0.26 | 110 | 105 | Invention |

It can be seen from Table 5 that Samples 11 to 15 containing a compound of formula (I) according to the present invention exhibit low fog and high sensitivity at a low exposure.

Incidentally, it was confirmed that RMS granularity and MTF of these samples were equal to those of Sample 2 of Example 1.

EXAMPLE 3

A multilayer color light-sensitive material was prepared by coating the following layers on a cellulose triacetate film support, in which Emulsions 1 or 2 as used in Sample 1 or 2 of Example 1 was used in the seventh layer. As a result of evaluations on photographic properties, it was proved that the use of Emulsion 2 according to the present invention brings about an improved relationship between sensitivity and granularity and an improved low intensity reciprocity law failure.

In the layer structure shown below, abbreviations for additives have the following meanings:

UV . . . ultraviolet absorbent
Solv . . . high-boiling organic solvent
ExF . . . dye
ExS . . . sensitizing dye
ExC . . . cyan coupler
ExM . . . magenta coupler
ExY . . . yellow coupler
Cpd . . . additive
H . . . gelatin hardening agent It should be noted that some of these additives have dual functions, and the above-stated specific function is merely a typical one.

| 1st Layer (Antihalation Layer): | |
|---|---|
| Black colloidal silver | 0.15 g-Ag/m$^2$ |
| Gelatin | 2.9 g/m$^2$ |
| UV-1 | 0.03 g/m$^2$ |
| UV-2 | 0.06 g/m$^2$ |
| UV-3 | 0.07 g/m$^2$ |
| Solv-2 | 0.08 g/m$^2$ |
| ExF-1 | 0.01 g/m$^2$ |
| ExF-2 | 0.01 g/m$^2$ |
| 2nd Layer (Low-Sensitive Red Sensitive Emulsion Layer): | |
| Silver iodobromide emulsion [AgI content: 4 mol % (homogeneous); sphere equivalent diameter: 0.4 μm; coefficient of variation of sphere equivalent diameter: 37%; tabular (aspect ratio: 3.0)] | 0.4 g-Ag/m$^2$ |
| Gelatin | 0.8 g/m$^2$ |
| ExS-1 | $2.3 \times 10^{-4}$ mol/mol-AgX (X: halogen) |
| ExS-2 | $1.4 \times 10^{-4}$ mol/mol-AgX |
| ExS-5 | $2.3 \times 10^{-4}$ mol/mol-AgX |
| ExS-7 | $8.0 \times 10^{-6}$ mol/mol-AgX |
| ExC-1 | 0.17 g/m$^2$ |
| ExC-2 | 0.03 g/m$^2$ |
| ExC-3 | 0.13 g/m$^2$ |
| 3rd Layer (Medium-Sensitive Red-Sensitive Emulsion Layer): | |
| Silver iodobromide emulsion [AgI content: 6 mol %; core-shell ratio: 2:1 (higher AgI content in the core*); sphere equivalent diameter: 0.65 μm; | 0.65 g-Ag/m$^2$ |

-continued

| | |
|---|---|
| coefficient of variation of sphere equivalent diameter: 25%; tabular (aspect ratio: 2.0)] | |
| Silver iodobromide emulsion [AgI content: 4 mol % (homogeneous); sphere equivalent diameter: 0.4 μm; coefficient of variation of sphere equivalent diameter: 37%; tabular (aspect ratio: 3.0)] | 0.1 g-Ag/m$^2$ |
| Gelatin | 1.0 g/m$^2$ |
| ExS-1 | $2 \times 10^{-4}$ mol/mol-AgX |
| ExS-2 | $1.2 \times 10^{-4}$ mol/mol-AgX |
| ExS-5 | $2 \times 10^{-4}$ mol/mol-AgX |
| ExS-7 | $7 \times 10^{-6}$ mol/mol-AgX |
| ExC-1 | 0.31 g/m$^2$ |
| ExC 2 | 0.01 g/m$^2$ |
| ExC-3 | 0.06 g/m$^2$ |

4th Layer (High-Sensitive Red-Sensitive Emulsion Layer):

| | |
|---|---|
| Silver iodobromide emulsion [AgI content: 6 mol %; core-shell ratio: 2:1 (higher AgI content in the core*); sphere equivalent diameter: 0.7 μm; coefficient of variation of sphere equivalent diameter: 25%; tabular (aspect ratio: 2.5)] | 0.9 g-Ag/m$^2$ |
| Gelatin | 0.8 g/m$^2$ |
| ExS-1 | $1.6 \times 10^{-4}$ mol/mol-AgX |
| ExS-2 | $1.6 \times 10^{-4}$ mol/mol-AgX |
| ExS-5 | $1.6 \times 10^{-4}$ mol/mol-AgX |
| ExS-7 | $6 \times 10^{-4}$ mol/mol-AgX |
| ExC-1 | 0.07 g/m$^2$ |
| ExC-4 | 0.05 g/m$^2$ |
| Solv-1 | 0.07 g/m$^2$ |
| Solv-2 | 0.20 g/m$^2$ |

5th Layer (Intermediate Layer):

| | |
|---|---|
| Gelatin | 0.6 g/m$^2$ |
| UV-4 | 0.03 g/m$^2$ |
| UV-5 | 0.04 g/m$^2$ |
| Cpd-1 | 0.1 g/m$^2$ |
| Polyethylacrylate latex | 0.08 g/m$^2$ |
| Solv-1 | 0.05 g/m$^2$ |

6th Layer (Low-Sensitive Green-Sensitive Emulsion Layer):

| | |
|---|---|
| Silver iodobromide emulsion [AgI content: 4 mol % (homogeneous); sphere equivalent diameter: 0.4 μm; coefficient of variation of sphere equivalent diameter: 37%; tabular (aspect ratio: 2.0)] | 0.18 g-Ag/m$^2$ |
| Gelatin | 0.4 g/m$^2$ |
| ExS-3 | $2 \times 10^{-4}$ mol/mol-AgX |
| ExS-4 | $7 \times 10^{-4}$ mol/mol-AgX |
| ExS-5 | $1 \times 10^{-4}$ mol/mol-AgX |
| ExM-5 | 0.11 g/m$^2$ |
| ExM-7 | 0.03 g/m$^2$ |
| ExY-8 | 0.01 g/m$^2$ |
| Solv-1 | 0.09 g/m$^2$ |
| Solv-4 | 0.01 g/m$^2$ |

7th Layer (Medium-Sensitive Green-Sensitive Emulsion Layer):

| | |
|---|---|
| Emulsion 1 or 2 | 0.27 g-Ag/m$^2$ |
| Gelatin | 0.6 g/m$^2$ |
| ExS-3 | $2 \times 10^{-4}$ mol/mol-AgX |
| ExS-4 | $7 \times 10^{-4}$ mol/mol-AgX |
| ExS-5 | $1 \times 10^{-4}$ mol/mol-AgX |
| ExM-5 | 0.17 g/m$^2$ |
| ExM-7 | 0.04 g/m$^2$ |
| ExY-8 | 0.02 g/m$^2$ |
| Solv-1 | 0.14 g/m$^2$ |
| Solv-4 | 0.02 g/m$^2$ |

8th Layer (High-Sensitive Green-Sensitive Emulsion Layer):

| | |
|---|---|
| Silver iodobromide emulsion [AgI content: 8.7 mol %; multilayer structure having a silver content ratio of 3:4:2 (AgI content: 24, 0, and 3 mol % from the core to the shell); sphere equivalent diameter: 0.7 μm; coefficient of variation of sphere equivalent diameter: 25%; tabular (aspect ratio: 1.6)] | 0.7 g-Ag/m$^2$ |
| Gelatin | 0.8 g/m$^2$ |

-continued

| | |
|---|---|
| ExS-4 | $5.2 \times 10^{-4}$ mol/mol-AgX |
| ExS-5 | $1 \times 10^{-4}$ mol/mol-AgX |
| ExS-8 | $0.3 \times 10^{-4}$ mol/mol-AgX |
| ExM-5 | 0.1 g/m$^2$ |
| ExM-6 | 0.03 g/m$^2$ |
| ExY-8 | 0.02 g/m$^2$ |
| ExC-1 | 0.02 g/m$^2$ |
| ExC-4 | 0.01 g/m$^2$ |
| Solv-1 | 0.25 g/m$^2$ |
| Solv 2 | 0.06 g/m$^2$ |
| Solv-4 | 0.01 g/m$^2$ |

9th Layer (Intermediate layer):

| | |
|---|---|
| Gelatin | 0.6 g/m$^2$ |
| Cpd-1 | 0.04 g/m$^2$ |
| Polyethylacrylate latex | 0.12 g/m$^2$ |
| Solv-1 | 0.02 g/m$^2$ |

10th Layer (Donor Layer Having Interlayer Effect on Red-Sensitive Emulsion Layer):

| | |
|---|---|
| Silver iodobromide emulsion [AgI content: 6 mol %; core-shell ratio: 2:1 (higher AgI content in the core*); sphere equivalent diameter: 0.7 μm; coefficient of variation of sphere equivalent diameter: 25%; tabular (aspect ratio: 2.0)] | 0.68 g-Ag/m$^2$ |
| Silver iodobromide emulsion [AgI content: 4 mol % (homogeneous); coefficient of sphere equivalent diameter: 37%; tabular (aspect ratio: 3.0)] | 0.19 g-Ag/m$^2$ |
| Gelatin | 1.0 g/m$^2$ |
| ExS-3 | $6 \times 10^{-4}$ mol/mol-AgX |
| ExM-10 | 0.19 g/m$^2$ |
| Solv-1 | 0.20 g/m$^2$ |

11th Layer (Yellow Filter Layer):

| | |
|---|---|
| Yellow colloidal silver | 0.06 g-Ag/m$^2$ |
| Gelatin | 0.8 g/m$^2$ |
| Cpd-2 | 0.13 g/m$^2$ |
| Solv-1 | 0.13 g/m$^2$ |
| Cpd-1 | 0.07 g/m$^2$ |
| Cpd-6 | 0.002 g/m$^2$ |
| H-1 | 0.13 g/m$^2$ |

12th Layer (Low-Sensitive Blue-Sensitive Emulsion Layer):

| | |
|---|---|
| Silver iodobromide emulsion [AgI content: 4.5 mol % (homogeneous); sphere equivalent diameter: 0.7 μm; coefficient of variation of sphere equivalent diameter: 15%; tabular (aspect ratio: 7.0)] | 0.3 g-Ag/m$^2$ |
| Silver iodobromide emulsion [AgI content: 3 mol % (homogeneous); sphere equivalent diameter: 0.3 μm; coefficient of variation of sphere equivalent diameter: 30%; tabular (aspect ratio: 7.0)] | 0.15 g-Ag/m$^2$ |
| Gelatin | 1.8 g/m$^2$ |
| ExS-6 | $9 \times 10^{-4}$ mol/mol-AgX |
| ExC-1 | 0.06 g/m$^2$ |
| ExC-4 | 0.03 g/m$^2$ |
| ExY-9 | 0.14 g/m$^2$ |
| ExY-11 | 0.89 g/m$^2$ |
| Solv-1 | 0.42 g/m$^2$ |

13th Layer (Intermediate Layer):

| | |
|---|---|
| Gelatin | 0.7 g/m$^2$ |
| ExY-12 | 0.20 g/m$^2$ |
| Solv-1 | 0.34 g/m$^2$ |

14th Layer (High-Sensitive Blue-Sensitive Emulsion Layer):

| | |
|---|---|
| Silver iodobromide emulsion [AgI content: 10 mol % (higher AgI content in the core*); sphere equivalent diameter: 1.0 μm; coefficient of variation of sphere equivalent diameter: 25%; polysynthetic twin tabular grains (aspect ratio: 2.0)] | 0.5 g-Ag/m$^2$ |
| Gelatin | 0.5 g/m$^2$ |
| ExS-6 | $1 \times 10^{-4}$ mol/mol-AgX |
| ExY-9 | 0.01 g/m$^2$ |
| ExY-11 | 0.20 g/m$^2$ |

-continued

| | |
|---|---|
| ExC-1 | 0.02 g/m$^2$ |
| Solv-1 | 0.10 g/m$^2$ |
| 15th Layer (1st Protective Layer): | |
| Fine silver bromide emulsion [AgI content: 2 mol % (homogeneous); sphere equivalent diameter: 0.07 μm)] | 0.12 g-Ag/m$^2$ |
| Gelatin | 0.9 g/m$^2$ |
| UV-4 | 0.11 g/m$^2$ |
| UV-5 | 0.16 g/m$^2$ |
| Solv-5 | 0.02 g/m$^2$ |
| H-1 | 0.13 g/m$^2$ |
| Cpd-5 | 0.10 g/m$^2$ |
| Polyethylacrylate latex | 0.09 g/m$^2$ |
| 16th Layer (2nd Protective Layer): | |

-continued

| | |
|---|---|
| Fine silver bromide emulsion [AgI content: 2 mol % (homogeneous); sphere equivalent diameter: 0.07 μm)] | 0.36 g-Ag/m$^2$ |
| Gelatin | 0.55 g/m$^2$ |
| Polymethylmethacrylate (particle diameter: 1.5 μm) | 0.2 g/m$^2$ |
| H-1 | 0.17 g/m$^2$ |

*AgI content in the core is higher than that in the shell.

Each of these layers further contained 0.07 g/m$^2$ of Cpd-3 as an emulsion stabilizer and 0.03 g/m$^2$ of a surface active agent Cpd-4 as a coating aid.

Compounds used in the sample light-sensitive material are as follows.

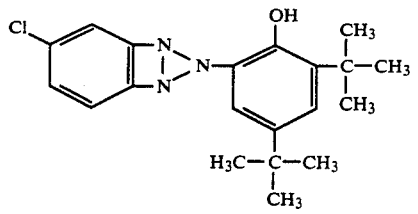

UV-1

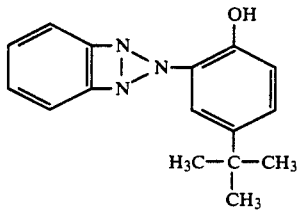

UV-2

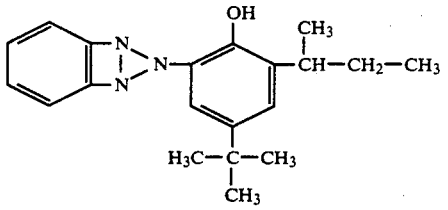

UV-3

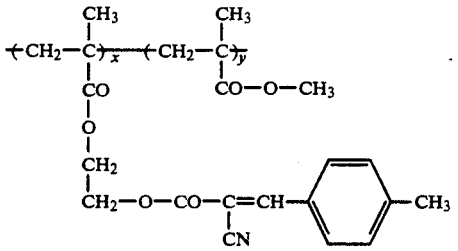

(x/y = 7/3 by wt)

UV-4

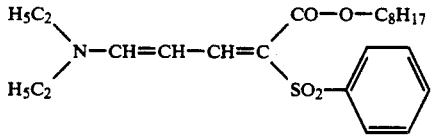

UV-5

-continued
Solv-1
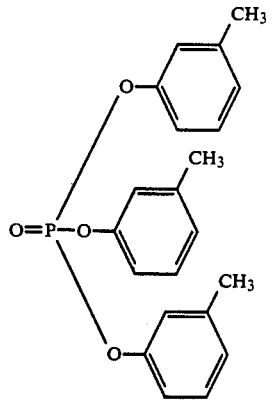
Solv-2
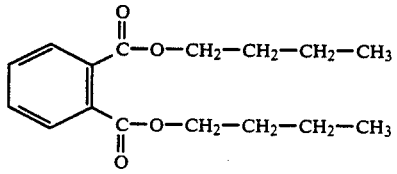
Solv-4
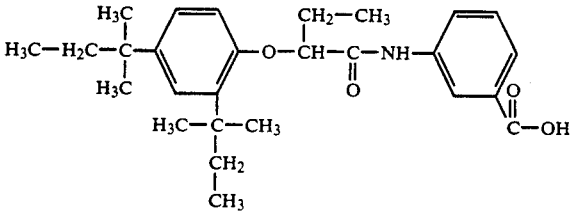
Solv-5
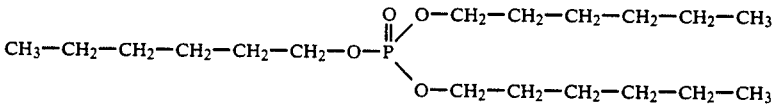
ExF-1
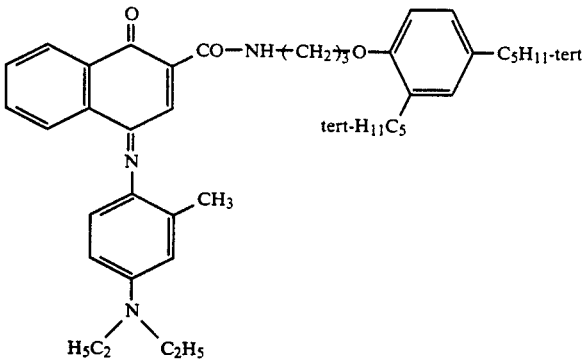
ExF-2
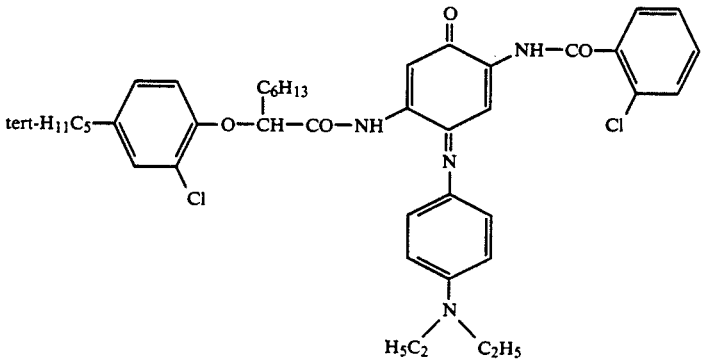

-continued
ExS-1
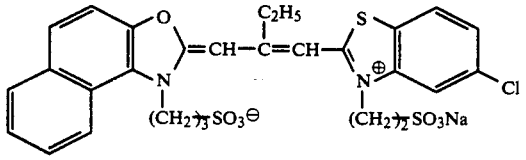
ExS-2
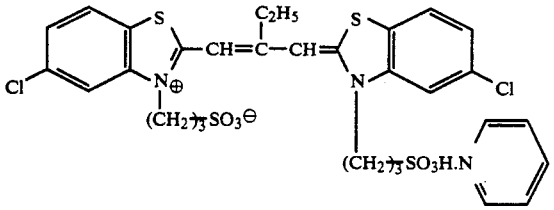
ExS-3
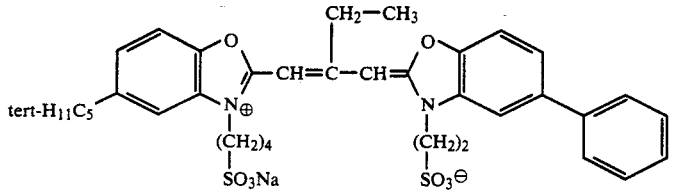
ExS-4
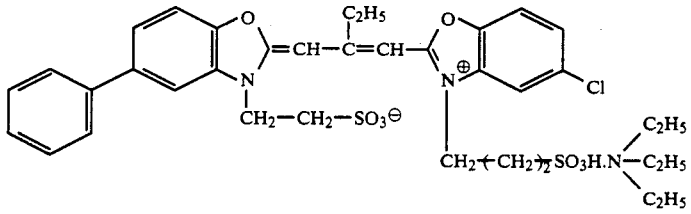
ExS-5
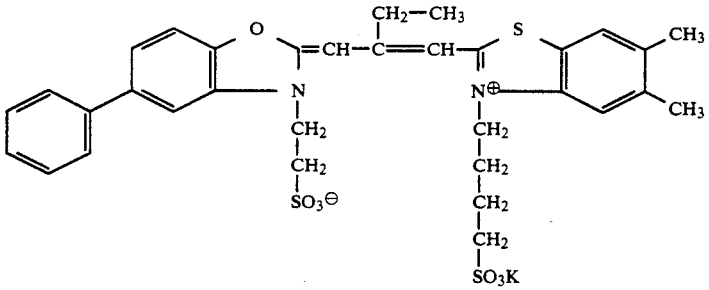
ExS-6
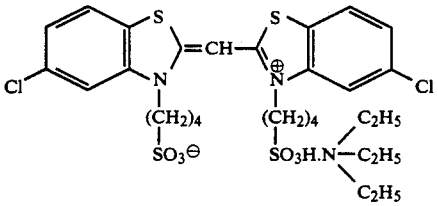
ExS-7
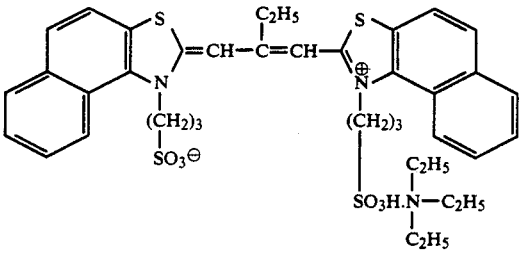

-continued
ExS-8
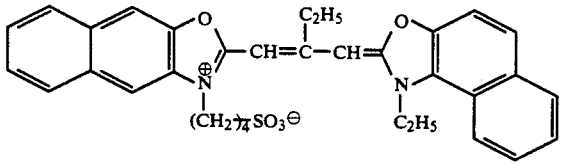
ExC-1
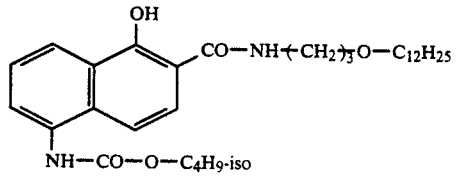
ExC-2
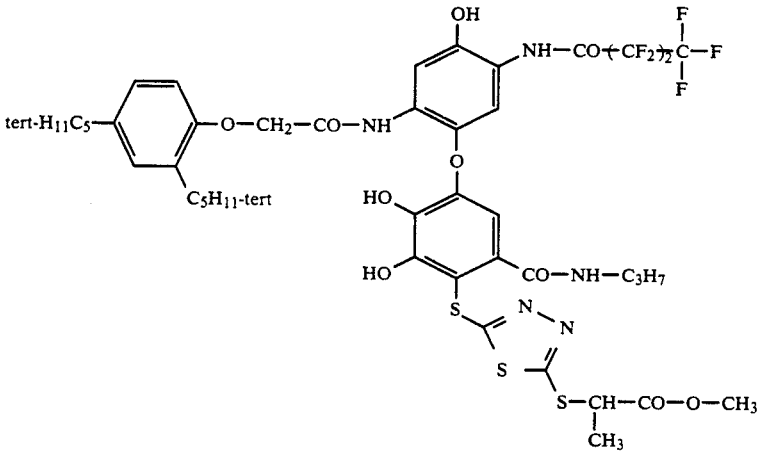
ExC-3
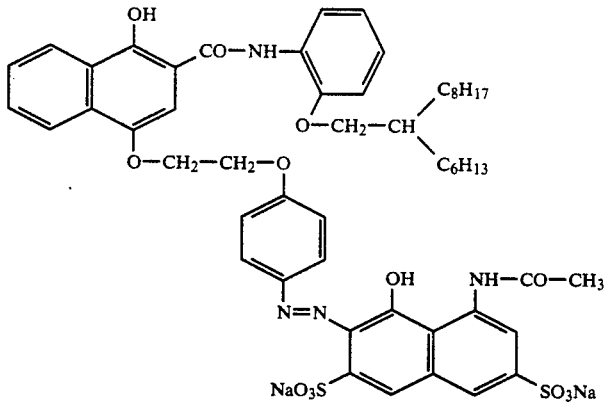
ExC-4
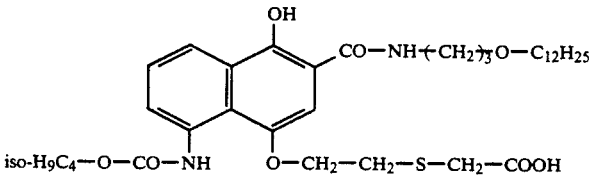

-continued
ExM-5
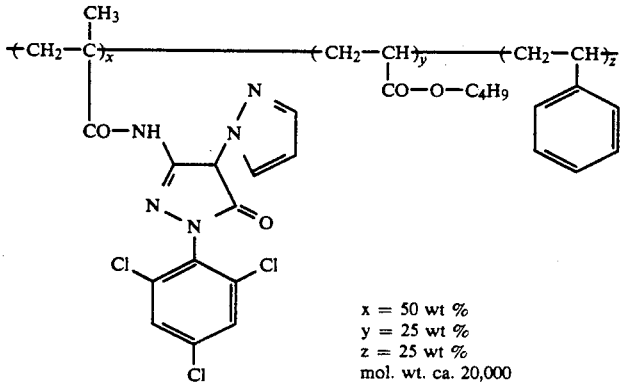
x = 50 wt %
y = 25 wt %
z = 25 wt %
mol. wt. ca. 20,000
ExM-6
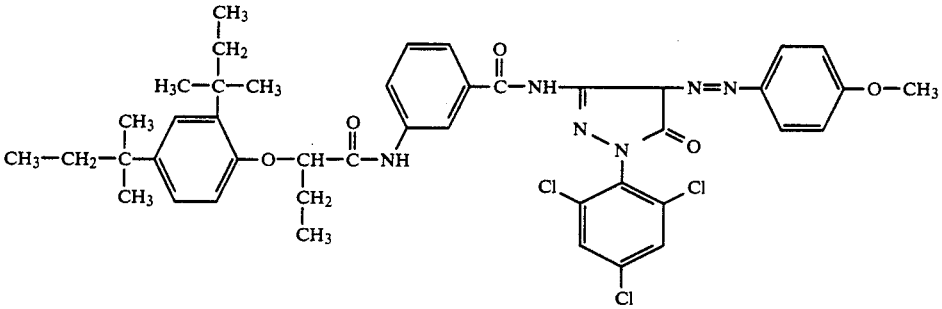
ExM-7
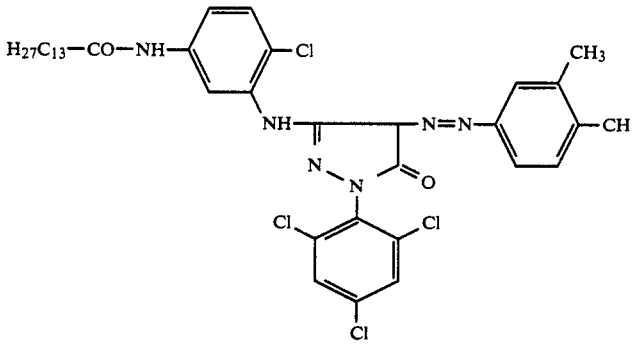
ExM-10
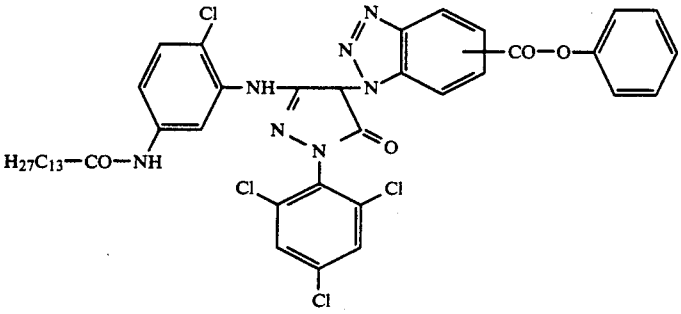

-continued
ExY-8
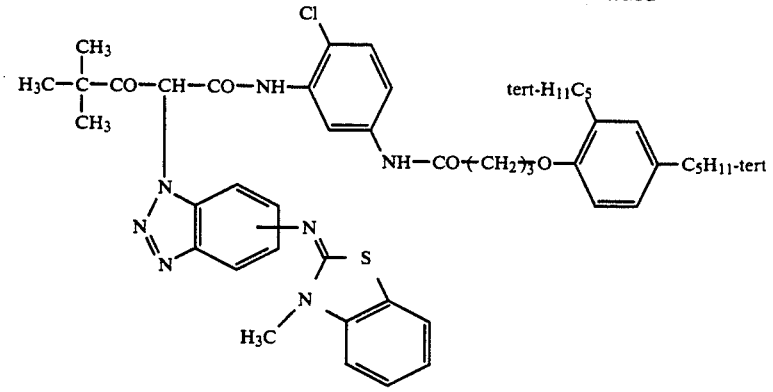
ExY-9
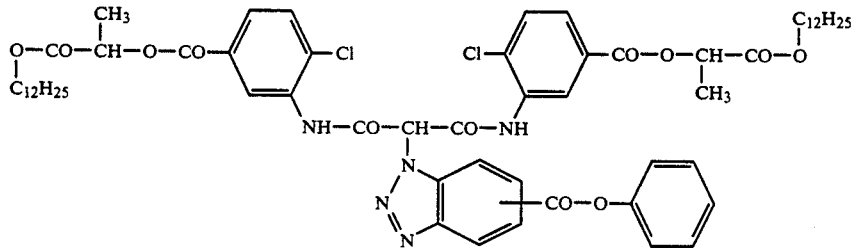
ExY-11
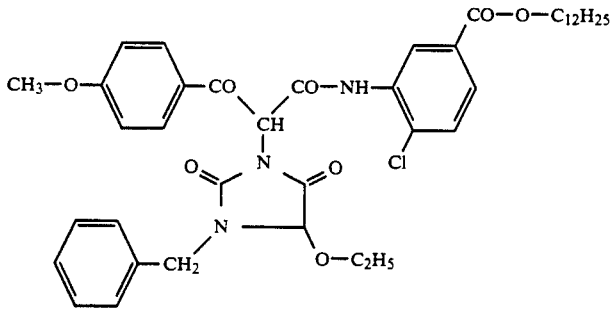
ExY-12
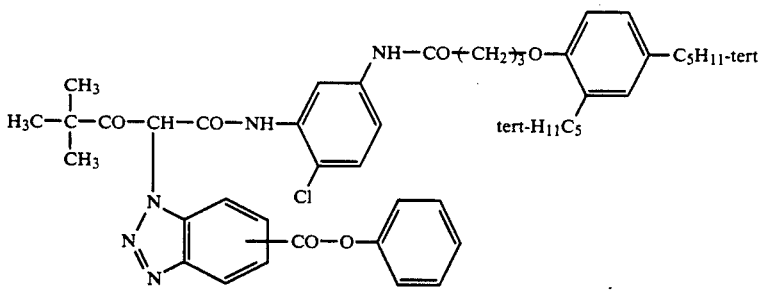
Cpd-1
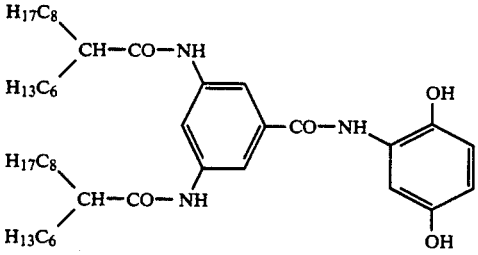
Cpd-2
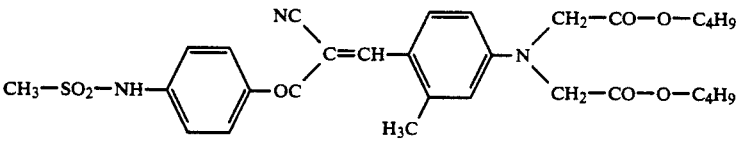

-continued

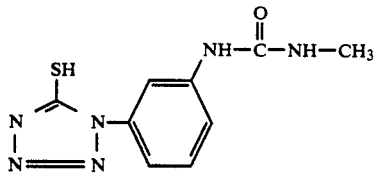

Cpd-6

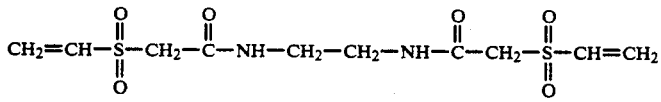

H-1

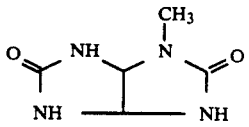

Cpd-5

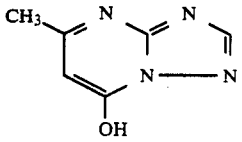

Cpd-3

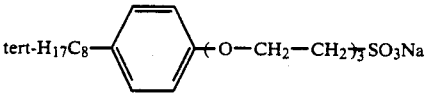

Cpd-4

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having provided thereon at least one silver halide emulsion layer, wherein said emulsion layer contains silver halide tabular grains having a diameter of not less than 0.15 μm in an amount of not less than 70% of the total projected area of the total silver halide grains, wherein at least 50% of the total number of all tabular grains have a ratio of grain thickness (b) to the longest distance between two or more parallel twinning planes (a) of not less than 5, and wherein said emulsion layer or other hydrophilic colloidal layer contains a compound represented by formula (I):

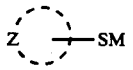

(I)

wherein Z represents a heterocyclic ring to which at least one group selected from —$SO_3M$, COOM, —OH, and —$NHR_2$ is bonded either directly or indirectly; M represents a hydrogen atom, an alkali metal atom, or —$NH_4$; $R_2$ represents a hydrogen atom, an alkyl group having from 1 to 6 carbon atoms, —COR3, —$COOR_3$, or —$SO_2R_3$; and $R_3$ represents an aliphatic group or an aromatic group.

2. A silver halide photographic material as in claim 1, wherein at least 90% of the total projected area of the total silver halide grains said emulsion layer contains tabular silver halide grains having a diameter of not less than 0.15 μm in.

3. A silver halide photographic material as in claim 1, wherein said tabular grains have a diameter of from 0.15 to 5.0 μm and a thickness of from 0.05 to 1.0 μm.

4. A silver halide photographic material as in claim 1, wherein at least 90% of the total number of the tabular grains have a b/a ratio of 5 or more.

5. A silver halide photographic material as in claim 1, wherein at least 50% of the total number of the tabular grains have a b/a ratio of 10 or more.

6. A silver halide photographic material as in claim 1, wherein at least 90% of the total number of the tabular grains have a b/a ratio of 10 or more.

7. A silver halide photographic material as in claim 1, wherein coefficients of variation of b, b/a ratio, and projected area of tabular grains are not more than 20%, not more than 20%, and not more than 30%, respectively.

8. A silver halide photographic material as in claim 1, wherein said tabular grains have an average aspect ratio of 8.0 or less.

9. A silver halide photographic material as in claim 1, wherein Z represents an imidazole ring residue, a tetrazole ring residue, a benzimidazole ring residue, a benzothiazole ring residue, a benzoxazole ring residue or a triazole ring residue.

10. A silver halide photographic material as in claim 1, wherein said compound represented by formula (I) is a compound represented by formula (II):

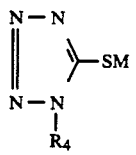

(II)

wherein $R_4$ represents an aliphatic, aromatic or heterocyclic group substituted with at least one of —COOM and —$SO_3M$.

11. A silver halide photographic material as in claim 1, wherein said compound represented by formula (I) is a compound represented by formula (III):

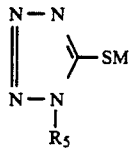

(III)

wherein $R_5$ represents a phenyl group substituted with at least one of —COOM and —$SO_3M$.

12. A silver halide photographic material as in claim 1, wherein said compound represented by formula (I) is present in an amount of from $1\times10^{-6}$ to $1\times10^{-1}$ mol per mol of silver.

13. A silver halide photographic material as in claim 1, wherein said compound represented by formula (I) is present in an amount of from $1\times10^{-5}$ to $8\times10^{-3}$ mol per mol of silver.

* * * * *